United States Patent [19]

Persson

[11] 4,153,812

[45] May 8, 1979

[54] BUS BAR ASSEMBLY

[75] Inventor: John A. Persson, Gibsonia, Pa.

[73] Assignee: Lectromelt Corporation, Pittsburgh, Pa.

[21] Appl. No.: 844,210

[22] Filed: Oct. 21, 1977

[51] Int. Cl.[2] ..... H05B 7/11

[52] U.S. Cl. ..... 13/12

[58] Field of Search ..... 13/12; 174/16 B, 16 BH, 174/15 WF, 15 C

[56] References Cited

U.S. PATENT DOCUMENTS

| | | | |
|---|---|---|---|
| 3,366,725 | 1/1968 | Watterson | 13/12 |
| 3,867,561 | 2/1975 | Paton et al. | 13/12 |
| 3,898,707 | 8/1975 | Trageser | 13/12 |

*Primary Examiner*—R. N. Envall, Jr.
*Attorney, Agent, or Firm*—Fred Wiviott

[57] ABSTRACT

Bus bars for connecting arc furnance electrodes to a transformer include pairs of flat, rectangular, hollow, conductive members having side surfaces substantially greater in length than the end surfaces. One side surfaces of the bus bar of each pair are disposed in a parallel, closely proximate relation with respect to the other and a sheet of insulating material disposed between said surfaces. The bus bars of each pair are connected to transformer terminals having different polarities. The bus bar pairs are arranged in a closely spaced parallel relation.

9 Claims, 9 Drawing Figures

FIG.4
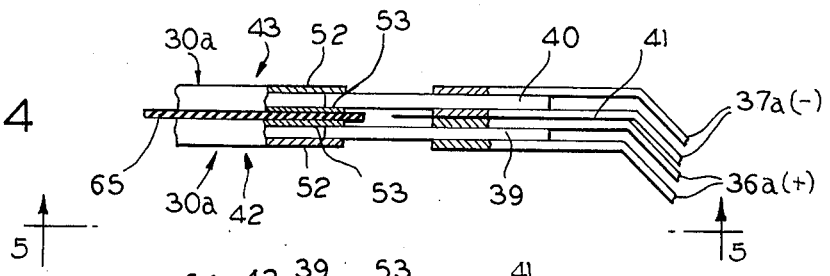
FIG.5
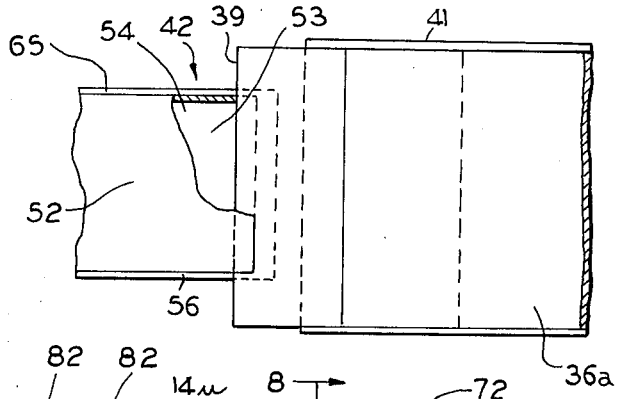
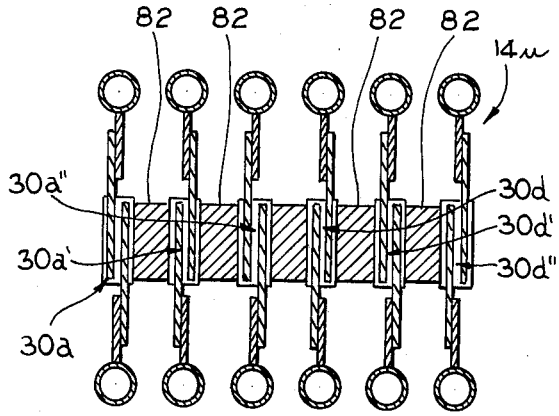
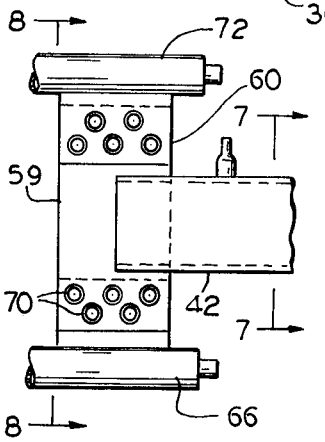
FIG.6
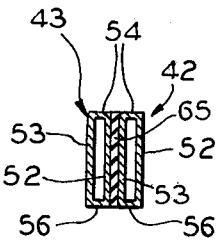
FIG.7
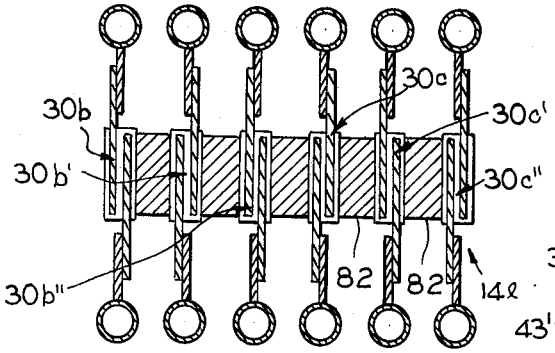
FIG.3
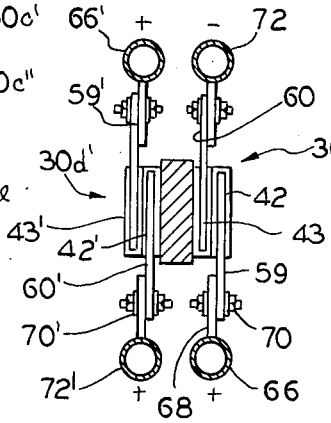
FIG.8
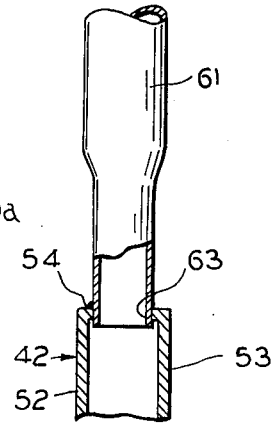
FIG.9

BUS BAR ASSEMBLY

BACKGROUND OF THE INVENTION

This invention relates to bus bars and more particlarly to bus bars employed for connecting arc furnace electrodes to power supply transformers.

In a typical arc furnace installation, a high voltage power supply is connected to a transformer to provide a high current output at a relatively low voltage. The transformers are usually located in a vault so as to isolate the transformer from the arc furnace. The bus bars extend from the transformer terminals through the vault wall with their opposite ends connected by conductors to electrode clamps. Conventional bus bars generally take the form of hollow, tubular members which are round or rectangular in transverse cross-section. Round tubes are usually spaced at least 2.25 times the tube diameter in order to avoid a detrimental redistribution of current. As a result, a relatively large area is necessary to accommodate the number and spacing of round bus bars necessary to carry the currents required in electric arc furnances. Rectangular bus bars have not been wholly satisfactory because the current tends to flow along only one surface of the bar, thereby minimizing the effective current carrying capacity.

SUMMARY OF THE INVENTION

It is an object of the invention to provide a new and improved bus bar system for high current density applications.

A more specific object of the invention is to provide a bus bar system for alternating current electric arc furnaces wherein high current density and low reactance are achieved.

A further object of the invention is to provide a bus bar system for arc furnace electrodes wherein current distributions permit efficient use of materials.

These and other objects and advantages of the present invention will become apparent from the detailed description of the invention taken with the accompanying drawings.

In general terms, the invention comprises a bus bar system for connecting arc furnace electrodes to a power supply transformer. The bus bars consist of hollow tubular members having one side which is substantially equal to the height of the member and which is disposed in closely spaced relation to the corresponding surface of another bus bar carrying an out of phase current. A thin layer of insulation is disposed between the bus bars.

BRIEF DESCRIPTION OF THE DRAWINGS

FIG. 3 is a view taken along lines 3—3 of FIG. 2;

FIG. 4 is an enlarged top view of a portion of the bus bar assembly illustrated in FIG. 1;

FIG. 5 is a view taken along lines 5—5 of FIG. 4 with parts broken away;

FIG. 6 is an enlarged fragmentary view of a portion of the bus bar assembly illustrated in FIG. 1;

FIG. 7 is a view taken along lines 7—7 of FIG. 6;

FIG. 8 is a view taken along lines 8—8 of FIG. 6; and

FIG. 9 is an enlarged fragmentary view of a portion of the bus bar assembly illustrated in FIG. 1.

DETAILED DESCRIPTION OF THE PREFERRED EMBODIMENT

Figure 1:
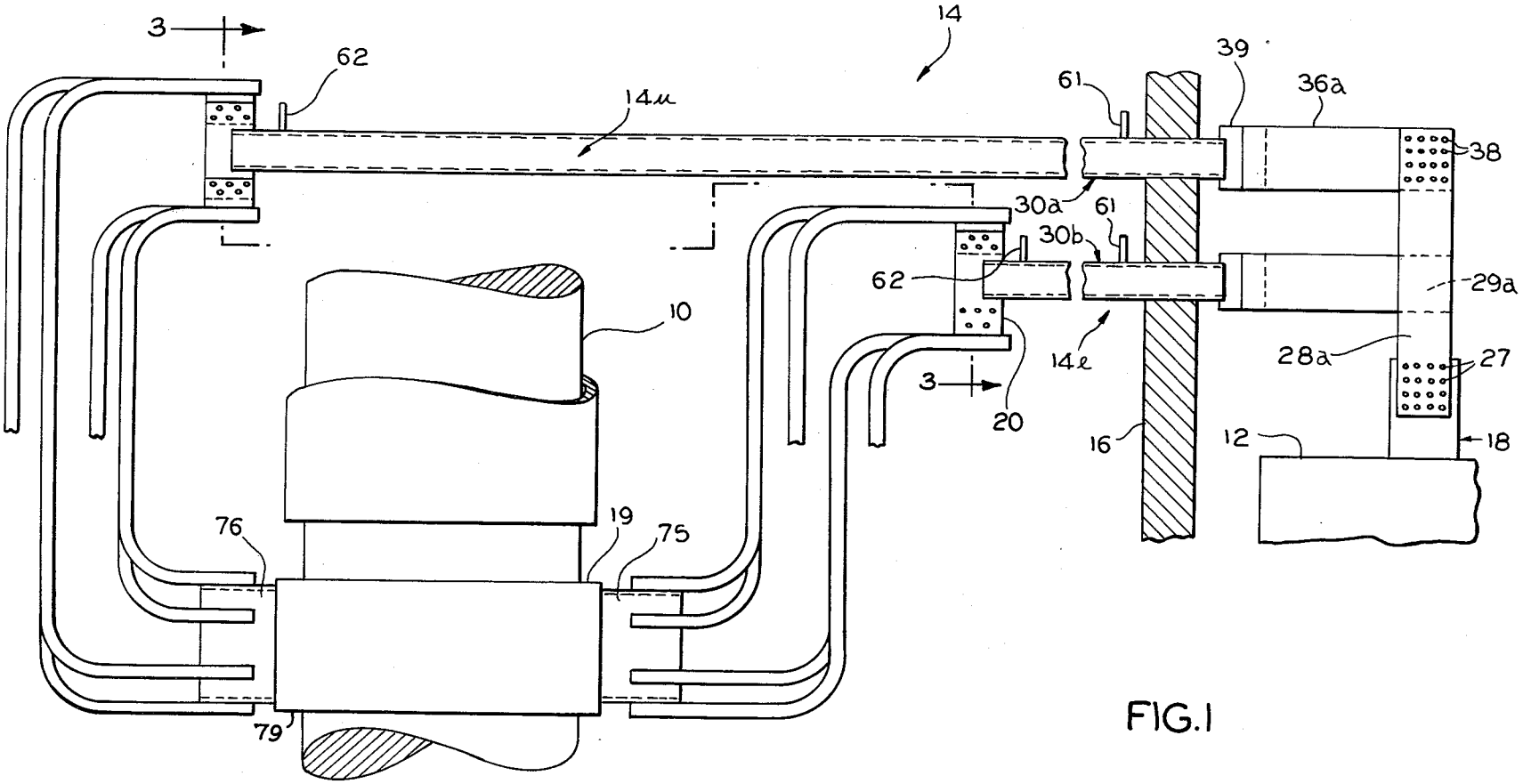
FIG. 1 is a side elevation view illustrating the bus bar system according to the present invention.
Figure 2:
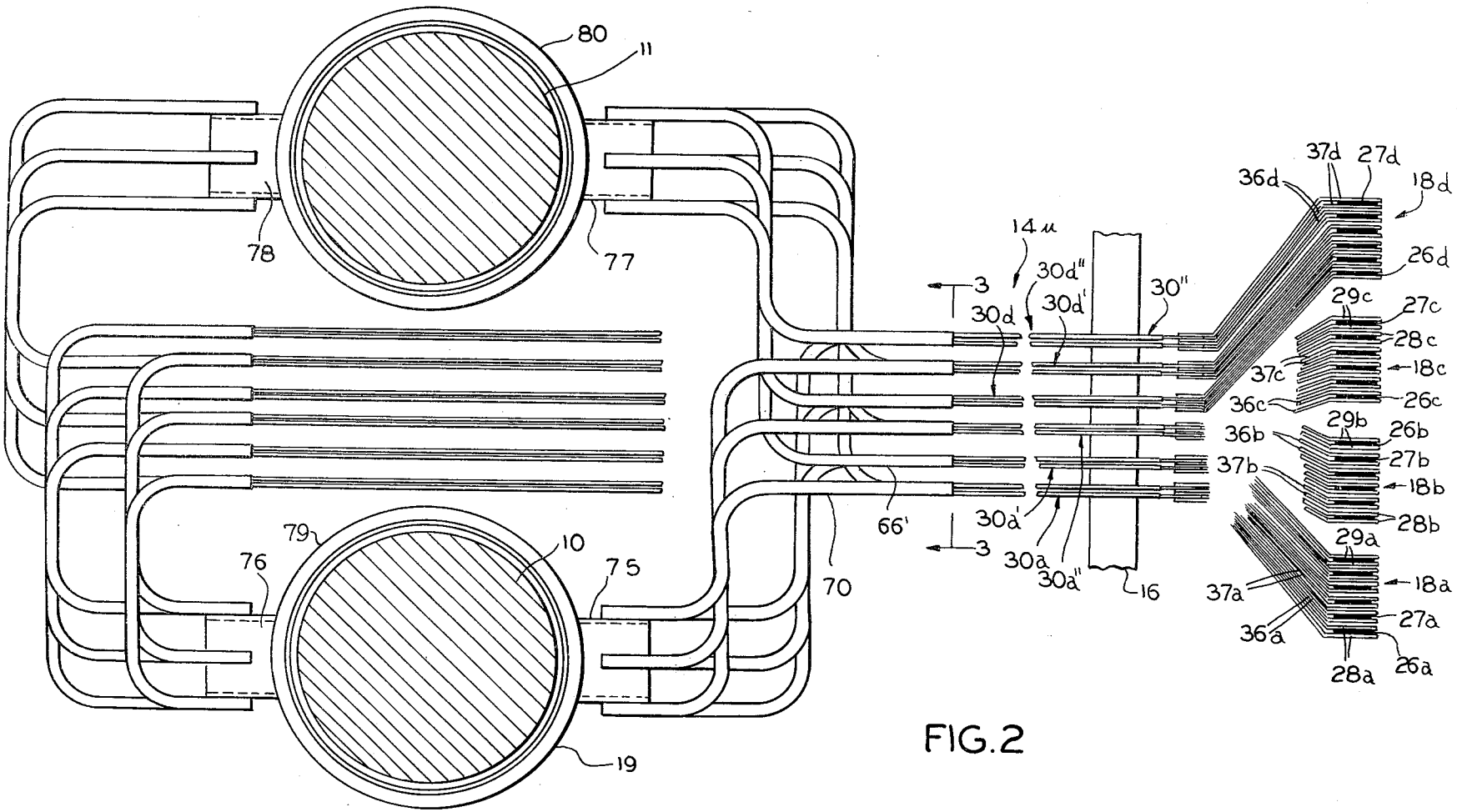
FIG. 2 is a top plan view of the bus bar system illustrated in FIG. 1.

FIGS. 1 and 2 illustrate a single phase alternating current system wherein a pair of electrodes 10 and 11 are connected to a transformer 12 by means of a bus bar assembly 14 in accordance with the invention. The transformer 12 only a fragementary portion of which is shown in FIG. 1, is disposed within a vault symbolized by the front wall segment 16.

As those skilled in the art will appreciate, the electrodes 10 and 11 will be suitably supported and will project downwardly to the roof of an electric arc furnace not shown. The primary terminals (not shown) of the transformer 12 are connected to a suitable alternating current source and the secondary terminals 18 thereof are connected by bus bars 14 to electrodes 10 and 11 by means of an electrode clamp 19. As a result, an arc is struck between the lower ends of the electrodes 10 and 11 and the molten metal within the furnace to be treated.

In the illustrated example, the transformer 12 has a plurality of secondary windings arranged in four groups as evidenced by terminal groups **18*a*, 18*b*, 18*c*, and 18*d*, as seen in FIG. 2. It will be appreciated that the voltage in each secondary winding is alternating and that accordingly the voltage at one winding end will be instantaneously positive while the voltage at the other end thereof will be instantaneously negative. The terminals of group 18*a*, for example, which are connected to the instantaneously positive terminals of associated secondary windings are identified by the reference numeral 26*a*, while those terminals of group 18*a*, which are connected to the instantaneously negative side of these secondary windings are identified by the reference number 27*a*. Correspondingly connected terminals of the other groups 18*b*, 18*c*, and 18*d* are identified by reference numberals 26*b*, 27*b*, 26*c*, 27*c*, 26*d*, and 27*d***.

Connected to and ascending vertically upwardly from each of the transformer terminals is a transformer riser extension bar by means of a plurality of bolts 27. For example, riser extension bars **28*a* are connected to the opposite side of the instantaneously positive transformer terminal 26*a*. While those riser extension bars connected to the instantaneously negative terminals 27*a*, are identified by reference number 29*a*. Transformer bars connected to the terminals of Groups 18*b*, 18*c* and 18*d*, and 24*d* are correspondingly identified by the reference numerals 28*b*, 29*b*, 28*c*, 29*c*, 28*d*, and 29*d***.

As seen in FIGS. 1, 2, and 3 the bus bar assembly 14, according to the invention is divided into an upper bus bar run **14*u* consisting of bus bar pairs 30*a*, 30*a*′, 30*a*″, 30*d*, 30*d*′ and 30*d*″ and a lower bus bar, run 141 consisting of bus bar pairs 30*b*, 30*b*′, 30*b*″, 30*c*, 30*c*′ and 30*c*″. Each of the riser extension bars 28*a*, 29*a*, 28*b*, and 29*b* connected to one of the bus bars of the upper bus run 14*u* and the riser extension bars 28*b*, 29*b*, 28*c*, and 29*c* are connected to the bus bars of the lower run 141. Toward this end, the riser bars 28*a*, 29*a*, 28*d*, and 29*d* of the outer two groups 18*a* and 18*d* are longer than bars 28*b*, 28*c*, 29*b* and 29*c* of the central groups 18*b* and 18*c*, so that the upper ends thereof extend to an elevation corresponding to that of the associated bus bar runs 14*u* and 141**.

The upper ends of the riser members **28*a*,29*a*,28*b*, 29*b*, 28*c*, 29*c*, 28*d* and 29*d* are respectively connected to the bus bar pairs 30*a*–30*d*″ by terminal members 36*a*, 37*a*, 36*b*,37*b*, 37*c*, 36*d*, and 37*d***. Each of the pairs of bus bar pairs 30a–30d' and terminal members 36a–37d are substantially identical and accordingly only the bus bar pair 30a and terminals 37a will now be discussed for the sake of brevity.

The terminal members 36a as shown in FIGS. 1, 2, 4 and 5 to be relatively elongate angular members which are secured at one end by means of the bolts 38 to the upper ends of terminal riser members 28a and extend forwardly in general parallelism. The opposite ends of terminals 36a are suitably affixed to the opposite sides of an elongate flat terminal bar 39. A second pair of terminal members, 37a, are fixed to the upper ends of transformer riser bars 27a and extend forwardly therefrom in general parallellism with each other and terminal members 36a with their opposite ends affixed to the opposite surfaces of a second terminal bar 40. It will be recalled that the terminals 36a are connected through risers 28a to an instantaneously positive side of the secondary windings while the terminals 37a are connected to Risers 27a to a negative side of said windings. Accordingly, terminals 36a have been identified in FIG. 4 by a (+) sign and terminals 37a by a (−) sign.

As also seen in FIG. 3, the innermost ones of the pair of terminals 36a and 37a are disposed in a closely spaced relation and have opposite polarities. It is necessary, therefore, to provide electrical insulation 41 therebetween. Insulation 41 takes the form of a thin sheet of insulating material having sufficient dielectric strength to withstand the potential between terminals 36a and 37a. One type of insulation which may be employed effectively for this purpose is identified by United States Government Specification as G7 and is composed of fiber glass and epoxy resin. For a system designed to carry a current of 130 KA, the thickness of insulation 41 should be approximately 0.031 inches.

The terminal members 39 and 40 are generally rectangular and have opposed planer surfaces. One end of each of terminals 39 and 40 are affixed to and overlapped by the terminals 36a and 37a respectively. The manner of connecting terminals 36a and 37a to terminal members 39 and 40 should insure a good physical and electrical joint. Since the various members are formed of copper or a cupreous material, braizing may be suitable for this purpose.

The bus bar pair 30a consists of bus bars 42 and 43 which are each shown in FIGS. 4, 5, 6, and 7 to comprise an elongate hollow member which is rectangular and transverse section and include sidewalls, a top wall 54 and a bottom wall 56. The side wall 53 of member 42 and 52 of member 43 are planer and disposed in a closely spaced parallel relation. The gap between inner surfaces of the side walls 52 and 53 of each of the tubular bus members 42 and 43 is equal to the width of its respective terminal member 39 or 40. In addition, a portion of each of the top and bottom walls 54 and 56 of each bus bar is cut away. This permits the sidewalls 52 and 53 of bus bars 42 and 43 to overlap terminals 39 and 40, to which they are suitably affixed in any suitable manner such as by brazing to provide a good electrical and mechanical connection. The opposite ends of each of the tubular bus bar members 42 and 43 are similarly connected to terminal members 59 and 60 respectively as shown in FIGS. 6 and 8. Specifically, the upper and lower walls 54 and 56 of each member are recessed so that the side wall 52 and 53 may engage the respective terminal member 59 and 60 to which they are suitably affixed by means of brazing.

It can be seen that the terminal members 39 and 40 and 59 and 60 effectively close the ends of the tubular bus bar members 42 and 43 and the brazing or other mechanical coupling provides a water tight seal between, whereby a hollow enclosure is defined. As seen in FIG. 1, cooling water inlet and outlet tubular connections 61 and 62 may be connected to each of the opposite ends of the individual bus bars. While the pipes 61 and 62 may be connected to the individual bus bars such as 42 in any suitable manner, in the preferred embodiment shown in FIG. 9, the lower end of pipe 61 for example is shown to be flattened for being received in a generally rectangular opening 63 top wall 54. Pipe 61 may be secured in opening 63 in any suitable manner such as by braising. In this manner, the cooling water may be circulated to each of the tubular bus bar members between inlet and outlet pipe connections 61 and 62.

The side wall 53 of 42 and 52 of bus bar 43 of each pair such as 30a, for example, are disposed in a parallel, closely spaced relation as they extend from terminals 39,40 to terminals 59, 60. Disposed in the gap between the outer surfaces of the adjacent walls 52 and 52 is an elongate planer sheet of insulating material 65, whose width is equal to or greater than the height of walls 52 and 53. While any suitable insulating material may be employed, in the illustrated embodiment material 65 may also be G-7, whose thickness will be at least equal to that of the insulation 41, but may be somewhat greater depending upon the dimensions of the various members.

With reference to FIGS. 7 and 8, it can be seen that the terminal 59 connected to the bus tube 42 of bus tube pair 30a extends vertically downwardly from said tube and the terminal 60 connected to the bus tube 43 of pair 30a extends upwardly. A tubular conductor 66 is connected by means of a terminal 68 and bolt 70 to the lower end of terminal 59 and a second tubular conductor, 72, is connected to the second terminal 60 in a similar manner. It will be recalled that of the bus tube pair 30a, bus tube 42 is instantaneously positive and the bus tube 43 is instantaneously negative, so that these polarities will carry over with respect to tubular conductors 66 and 72. The components of the next adjacent bus bar pair 30a' are identified in FIG. 8 by the same reference numerals as those employed with respect to tubular bus bar conductor 30a except that a prime (') is employed with respect to the components of bus bar pair 30a'. It can be seen, that the terminal 59' associated with bus bar 42' extends downwardly. The same configuration is employed with each of the alternate pairs of bus bars in each of the upper and lower bus runs 14u and 141. Accordingly, alternate runs of the adjacent tubular conductors are instantaneously energized by an opposite potential. All of the tubular conductors which are connected to positive bus bars as shown in FIG. 2 to extend towards the instantaneously positively energized electrode 10, where they terminate on terminals 75 with respect to lower bus run and 76 with respect to the upper bus run. Similarly, all of the tubular conductors which are connected to instantaneously negative bus bars extend toward the electrode 11 where they are connected to terminals 77 and 78.

The terminals 75 and 76 are each suitably connected to an electrode clamp 79, which engages electrode 10, and terminals 77 and 78 engage electrode clamp 80, which engages electrode 11. The terminals 75–78 and the clamps 79 and 80 form no part of the present invention and accordingly, have only been schematically illustrated. It will be appreciated, however, that the clamps 79 and 80 are in high pressure engagement with the outer surface of their respective electrodes to provide a low resistance current transfer path.

It will also be appreciated that the bus bars of each of the bus runs 14*u* and 141 and the various tubular conductors extending between the bus bars and the electrode clamps must be suitably supported. This may be accomplished in any conventional manner. For example, the bus bars of each pair may be suitably affixed to insulating members 82 which are arranged between adjacent bus bar pairs as shown in FIG. 3. The insulating members are in turn connected to and supported by elongate support members mounted at their upper ends on a superstructure (not shown). For more complete description of a support assembly which may be employed with the present invention, reference is made to U.S. Pat. No. 4,018,975 issued Apr. 19, 1977 and assigned to the assignee of the present invention.

The bus bars according to the present invention permits an arrangement which is compact both in the horizontal and vertical directions. The connection of the bus bars of each pair to the opposite sides of a secondary winding tends to concentrate the current on the relatively large facing surfaces. In addition, the magnetic field tends to be concentrated between the adjacent bus bars of each pair to minimize inductive reactance effects between the bus bars of different pairs. A relatively thin wall tube is preferred, i.e., approximately ⅜" for a 60 Hz System for relatively closely packed horizontal array, or about 3/16" for a 60 Hz system in a case of widely spaced arrangement or a vertical array. An example of the external dimension of a bus bar for 130 KA system would be 9⅜" in height and 1¼" in diameter and a space in between vertical sidewalls of 13/16".

While only a single embodiment of the invention has been illustrated and described, it is not intended to be limited thereby, but only by the scope of the intended claims. For example, while only a pair of electrodes are illustrated, the system may be employed with furnances having a greater number of electrodes and in other than single phase energization.

I claim:

1. A bus bar system for connecting a transformer to the electrodes of an electric arc furnace, bus bar means comprising a plurality of hollow members each having a transverse cross-section whose height is substantially greater than its width, said bus members being arranged in pairs, a generally planar surface formed on each member and having a dimension substantially equal to the height of said members, the generally planar surfaces on the members of each pair being disposed in an opposed generally parallel relation, and in relatively close proximity, and an insulating material disposed between said surfaces.

2. The system set forth in claim 1 wherein said members are generally rectangular in transverse cross-section, terminal means connected in a sealed relation, to the opposite ends of each of said members, and cooling liquid inlet and outlet connections connected to the hollow interior of each of said tubular members.

3. The system set forth in claim 2 wherein the transformer has secondary winding means, one bus bar member of each pair being connected to a different end of said secondary winding means.

4. The system set forth in claim 3 wherein said transformer is of the single phase alternating current type and the members of each pair are connected to be energized by currents which have instantaneously opposite polarities.

5. The system set forth in claim 4 wherein said transformer has first and second pluralities of terminals respectively connected to receive currents having one of said instantaneously opposite polorities, one member of each pair being connected to one terminal of said first plurality of terminals and the other member of said pair being connected to one terminal of said second plurality of terminals, said pairs of members being arranged in at least one equi-spaced row.

6. The system set forth in claim 1 wherein said members are thin-walled and rectangular in transverse cross-section, said generally planer surfaces being one of the side walls of said members, said insulation being a relatively thin sheet of material.

7. A bus bar system for connecting a transformer to the electrodes of an electric arc furnace, bus bars comprising a plurality of elongate hollow members, said members being generally rectangular in transverse cross-section and each having a side wall whose height is substantially greater than the width of said members, said bus bars being arranged in pairs, the side walls of the bus bar members of each pair being disposed in an opposed generally parallel relation to each other and in relatively close proximity, and a thin sheet of insulating material having a high dielectric strength being disposed between the side walls of each pair, terminal means connected to the opposite ends of each of said tubular bus bar members in a sealed relation, and cooling liquid inlet and outlet connections connected to the hollow interior of each of said members.

8. A bus bar system for connecting a transformer to the electrodes of an electric arc furnace, a plurality of bus bars each comprising an elongate hollow member, said members being rectilinear in transverse cross-section and each having first and second dimensions in said transverse cross-section, said first dimension being greater than said second dimension and lying on a first surface of said members, said bus bars being arranged in pairs, the first surfaces of the members of each pair being disposed in an opposed generally parallel relation to each other and in relatively close proximity, and a thin sheet of insulating material having a high dielectric strength disposed between the first surfaces of each pair, and terminal means connected to the opposite ends of each of said members for connecting the same to said electrode and transformer, respectively.

9. The system set forth in claim 8 wherein the transformer has secondary winding means, one bus bar of each pair being connected to a different portion of the secondary winding so that the currents flowing in the bus bars of each pair are out of phase.

* * * * *